US009694247B2

(12) United States Patent
Nurnberg

(10) Patent No.: US 9,694,247 B2
(45) Date of Patent: Jul. 4, 2017

(54) BALL FOR A BALL SPORT

(71) Applicant: adidas AG, Herzogenaurach (DE)

(72) Inventor: Hans-Peter Nurnberg, Gutenstetten (DE)

(73) Assignee: adidas AG, Herzogenaurach (DE)

( * ) Notice: Subject to any disclaimer, the term of this patent is extended or adjusted under 35 U.S.C. 154(b) by 288 days.

(21) Appl. No.: 14/179,273

(22) Filed: Feb. 12, 2014

(65) Prior Publication Data

US 2014/0235379 A1 Aug. 21, 2014

(30) Foreign Application Priority Data

Feb. 15, 2013 (DE) ..... 10 2013 202 485

(51) Int. Cl.

| | |
|---|---|
| ***A63B 43/00*** | (2006.01) |
| ***A63B 37/00*** | (2006.01) |
| ***A63B 41/02*** | (2006.01) |
| ***A63B 47/00*** | (2006.01) |
| *A63B 102/32* | (2015.01) |

(52) U.S. Cl.

CPC ..... *A63B 43/004* (2013.01); *A63B 37/0003* (2013.01); *A63B 41/02* (2013.01); *A63B 43/00* (2013.01); *A63B 47/005* (2013.01); *A63B 2102/32* (2015.10); *A63B 2209/00* (2013.01); *A63B 2220/833* (2013.01); *A63B 2225/305* (2013.01); *A63B 2225/50* (2013.01); *A63B 2225/54* (2013.01); *A63B 2225/64* (2013.01); *A63B 2225/66* (2013.01); *A63B 2243/0025* (2013.01); *A63B 2243/0095* (2013.01)

(58) Field of Classification Search

CPC ..... A63B 41/02; A63B 37/02; A63B 41/00; A63B 43/00; A63B 43/002; A63B 43/004; A63B 43/04; A63B 43/06; A63B 47/005; A63B 2225/64; A63B 37/003; A63B 2209/00; A63B 2220/833; A63B 2225/305; A63B 2225/50; A63B 2225/54; A63B 2225/66; A63B 2243/0025; A63B 2243/0095; A63B 2702/32

See application file for complete search history.

(56) References Cited

U.S. PATENT DOCUMENTS

| | | | | |
|---|---|---|---|---|
| 415,884 | A | 11/1889 | Shibe | |
| 495,863 | A | 4/1893 | Whitzel | |
| 830,582 | A | 9/1906 | Fleischman | |
| 1,187,029 | A | 6/1916 | Beebout | |
| 1,583,721 | A * | 5/1926 | Kane ..... | A63B 24/0021 116/214 |
| 1,597,823 | A | 8/1926 | Randolph | |

(Continued)

FOREIGN PATENT DOCUMENTS

| | | |
|---|---|---|
| CA | 1104601 | 7/1981 |
| CH | 403593 | 11/1965 |

(Continued)

OTHER PUBLICATIONS

Opposition of Therm-IC-Products GmbH as filed on Jul. 4, 2008.

(Continued)

*Primary Examiner* — Steven Wong

(74) *Attorney, Agent, or Firm* — Kilpatrick Townsend & Stockton LLP

(57) ABSTRACT

Described are balls for a ball sport, wherein the ball includes at least one heating element.

25 Claims, 4 Drawing Sheets

(56) References Cited

U.S. PATENT DOCUMENTS 1,614,853 A 1/1927 Schwartz
1,664,397 A * 4/1928 Bens ..... A63B 24/0021 116/214
1,923,236 A 8/1933 Sonnett
2,020,484 A 11/1935 Turner
2,078,881 A 4/1937 Munzinger
2,221,534 A 11/1940 Voit et al.
2,653,817 A 9/1953 Tebbetts, Jr.
2,653,818 A 9/1953 Tebbetts, Jr. et al.
2,760,278 A 8/1956 Agrillo
2,874,964 A 2/1959 Edwards
2,897,609 A 8/1959 Bodkin
3,112,521 A 12/1963 Ward
3,119,618 A 1/1964 Molitor et al.
3,185,476 A 5/1965 Fechner
3,229,976 A 1/1966 Allen, Jr.
3,233,544 A * 2/1966 Hosoya ..... A63B 37/0003 102/334
3,508,750 A 4/1970 Henderson
3,580,575 A 5/1971 Speeth
3,616,165 A 10/1971 Nishi
4,065,150 A 12/1977 Van Auken
4,140,893 A * 2/1979 Renteria ..... A63B 47/005 219/385
4,154,789 A 5/1979 Delacoste
4,175,446 A 11/1979 Crowninshield et al.
4,187,134 A 2/1980 Svub et al.
4,261,565 A 4/1981 Massino, Sr.
4,285,846 A 8/1981 Hardy et al.
4,333,648 A 6/1982 Aoyama
4,399,992 A 8/1983 Molitor
4,402,147 A 9/1983 Wu
4,462,590 A 7/1984 Mitchell
4,564,199 A * 1/1986 Adams ..... A63B 43/00 473/200
4,614,340 A * 9/1986 Hosoya ..... F42B 4/00 102/334
4,649,552 A 3/1987 Yukawa
4,651,446 A 3/1987 Yukawa et al.
4,660,831 A 4/1987 Kralik
4,703,445 A 10/1987 Dassler
4,771,394 A 9/1988 Cavanagh
4,798,386 A 1/1989 Berard
4,802,671 A 2/1989 Gentiluomo
4,814,661 A 3/1989 Ratzlaff et al.
4,826,177 A 5/1989 Ponte
4,856,781 A 8/1989 Shishido et al.
4,870,700 A 9/1989 Ormanns et al.
4,998,734 A 3/1991 Meyer
5,040,795 A 8/1991 Sonntag
5,086,574 A 2/1992 Bacchiocchi
5,091,265 A 2/1992 Kennedy et al.
5,096,756 A 3/1992 Walters et al.
5,102,131 A * 4/1992 Remington ..... A63B 43/06 428/11
5,104,126 A 4/1992 Gentiluomo
5,123,659 A 6/1992 Williams
5,179,792 A 1/1993 Brantingham
5,181,717 A 1/1993 Donntag et al.
5,269,081 A 12/1993 Gray
5,285,586 A 2/1994 Goldston et al.
5,294,112 A 3/1994 Smith
5,310,178 A 5/1994 Walker et al.
5,320,345 A 6/1994 Lai et al.
5,325,869 A 7/1994 Stokes
5,335,188 A 8/1994 Brisson
5,357,696 A 10/1994 Gray et al.
D352,317 S 11/1994 Bassignani
5,369,896 A 12/1994 Frachey et al.
5,373,651 A 12/1994 Wood
5,383,290 A 1/1995 Grim
5,405,469 A 4/1995 Lin
5,413,331 A 5/1995 Stillinger
D360,917 S 8/1995 Fernandez
5,471,405 A 11/1995 Marsh
5,473,518 A 12/1995 Haber et al.
5,490,338 A 2/1996 Hwang et al.
5,500,635 A 3/1996 Mott
5,516,107 A 5/1996 Okumoto et al.
5,557,259 A 9/1996 Musa
5,557,865 A 9/1996 Sjosvard
5,566,479 A 10/1996 Gray et al.
5,574,432 A 11/1996 McCarthy
5,583,776 A 12/1996 Levi et al.
5,592,759 A 1/1997 Cox
5,596,652 A 1/1997 Piatek et al.
5,598,849 A 2/1997 Browne
5,611,540 A 3/1997 Williams et al.
5,636,146 A 6/1997 Flentov et al.
5,640,786 A 6/1997 Buyayez
5,644,858 A 7/1997 Bemis
5,649,701 A 7/1997 Mills et al.
5,655,316 A 8/1997 Huang
5,672,120 A 9/1997 Ramirez et al.
5,688,192 A 11/1997 Aoyama
5,688,198 A 11/1997 Teifert et al.
5,711,725 A 1/1998 Bengtson
5,720,200 A 2/1998 Anderson et al.
5,724,265 A 3/1998 Hutchings
5,724,667 A 3/1998 Furuno
5,725,445 A 3/1998 Kennedy et al.
5,732,486 A 3/1998 Rapisarda
5,741,195 A 4/1998 Sullivan et al.
5,748,087 A 5/1998 Ingargiola et al.
5,752,890 A 5/1998 Shishido et al.
5,755,634 A 5/1998 Huang
5,759,123 A 6/1998 Ou
5,766,707 A 6/1998 Obermaier
5,772,545 A 6/1998 Ou
5,775,005 A 7/1998 McClelland
5,793,882 A 8/1998 Piatek et al.
5,794,361 A 8/1998 Sadler
5,813,142 A 9/1998 Demon
5,815,954 A 10/1998 Huang
5,823,889 A 10/1998 Aoyama
5,865,697 A 2/1999 Molitor et al.
5,875,571 A 3/1999 Huang
5,883,569 A 3/1999 Kolefas
5,888,156 A 3/1999 Cmiel et al.
5,888,157 A 3/1999 Guenther et al.
5,890,997 A 4/1999 Roth
5,915,373 A * 6/1999 Malover ..... A63B 55/20 126/263.01
5,918,502 A 7/1999 Bishop
5,929,332 A 7/1999 Brown
5,931,752 A 8/1999 Guenther et al.
5,931,763 A 8/1999 Alessandri
5,937,462 A 8/1999 Huang
5,955,667 A 9/1999 Fyfe
5,960,380 A 9/1999 Flentov et al.
5,970,631 A 10/1999 Inman
5,983,529 A 11/1999 Serna
5,998,771 A * 12/1999 Mariano ..... H05B 6/64 219/528
D418,565 S 1/2000 Burgess
6,012,822 A 1/2000 Robinson
6,013,007 A 1/2000 Root et al.
6,014,080 A 1/2000 Layson, Jr.
6,017,128 A 1/2000 Goldston et al.
6,018,705 A 1/2000 Gaudet et al.
6,052,654 A 4/2000 Gaudet et al.
6,057,530 A * 5/2000 Gurevich ..... A41D 13/0051 219/529
6,077,193 A 6/2000 Buhler et al.
6,099,423 A 8/2000 Ou
6,122,340 A 9/2000 Darley et al.
6,122,846 A 9/2000 Gray et al.
6,157,898 A 12/2000 Marinelli
6,160,254 A 12/2000 Zimmerman et al.
6,183,425 B1 2/2001 Whalen et al.
6,195,921 B1 3/2001 Truong
6,206,795 B1 3/2001 Ou
6,230,501 B1 5/2001 Bailey, Sr. et al.

(56) References Cited

U.S. PATENT DOCUMENTS 6,245,862 B1 6/2001 Rajagopalan
6,251,035 B1 6/2001 Fa
6,266,623 B1 7/2001 Vock et al.
6,278,378 B1 8/2001 Feiner et al.
6,298,314 B1 10/2001 Blackadar et al.
6,302,815 B1 10/2001 Shishido et al.
6,306,054 B1 10/2001 Dobrounig
6,312,361 B1 11/2001 Hayes
6,336,365 B1 1/2002 Blackadar et al.
6,357,147 B1 3/2002 Darley et al.
6,375,612 B1 4/2002 Guichon et al.
6,396,413 B2 5/2002 Hines et al.
6,398,616 B1 6/2002 Motosko, III
6,424,264 B1 7/2002 Giraldin et al.
6,430,843 B1 8/2002 Potter et al.
6,458,229 B2 10/2002 Dobrounig
6,493,652 B1 12/2002 Ohlenbusch et al.
6,496,787 B1 12/2002 Flentov et al.
6,498,994 B2 12/2002 Vock et al.
6,499,000 B2 12/2002 Flentov et al.
6,503,162 B1 1/2003 Shishido et al.
6,516,284 B2 2/2003 Flentov et al.
6,526,158 B1 2/2003 Goldberg
6,531,963 B1 3/2003 Nyfelt
6,536,139 B2 3/2003 Darley et al.
6,537,125 B1 3/2003 Motosko, III
6,539,336 B1 3/2003 Vock et al.
6,560,903 B1 5/2003 Darley
6,569,092 B1 5/2003 Guichon et al.
6,589,630 B1 7/2003 Crow
6,600,407 B2 7/2003 Paek
6,611,789 B1 8/2003 Darley
6,614,392 B2 9/2003 Howard
D482,418 S 11/2003 Estefano
6,661,782 B1 12/2003 Mustajärvi et al.
6,685,585 B2 2/2004 Shishido et al.
6,788,200 B1 9/2004 Jamel et al.
6,807,753 B2 10/2004 Steszyn et al.
6,807,869 B2 10/2004 Farringdon et al.
6,808,462 B2 10/2004 Snyder et al.
6,813,586 B1 11/2004 Vock et al.
6,825,777 B2 11/2004 Vock et al.
6,856,934 B2 2/2005 Vock et al.
6,865,825 B2 3/2005 Bailey, Sr. et al.
6,876,947 B1 4/2005 Darley et al.
6,882,955 B1 4/2005 Ohlenbusch et al.
6,885,971 B2 4/2005 Vock et al.
6,898,550 B1 5/2005 Blackadar et al.
6,959,259 B2 10/2005 Vock et al.
6,963,818 B2 11/2005 Flentov et al.
7,062,225 B2 6/2006 White
7,072,789 B2 7/2006 Vock et al.
7,083,296 B2 8/2006 Chiang
7,092,846 B2 8/2006 Vock et al.
7,107,706 B1 9/2006 Bailey, Sr. et al.
7,138,613 B1 * 11/2006 Walsh ..... A63B 47/005 219/385
7,158,912 B2 1/2007 Vock et al.
7,162,392 B2 1/2007 Vock et al.
7,200,517 B2 4/2007 Darley et al.
7,204,041 B1 4/2007 Bailey, Sr. et al.
7,219,449 B1 5/2007 Hoffberg et al.
7,225,565 B2 6/2007 DiBenedetto et al.
7,230,212 B1 * 6/2007 Sarkisian ..... A63B 47/005 219/385
7,727,097 B2 * 6/2010 Siegel ..... A63B 24/0021 446/24
7,740,551 B2 * 6/2010 Nurnberg ..... A63B 41/02 473/570
8,231,487 B2 7/2012 Nurnberg et al.
8,512,177 B2 * 8/2013 Krysiak ..... A63B 41/02 473/570
2001/0054014 A1 12/2001 Noda et al.
2002/0022551 A1 2/2002 Watterson et al.
2002/0077201 A1 6/2002 Davies
2002/0077883 A1 6/2002 Lancos et al.
2002/0080198 A1 6/2002 Giraldin et al.
2002/0091796 A1 7/2002 Higginson et al.
2002/0116147 A1 8/2002 Vock et al.
2002/0142887 A1 10/2002 O'Malley
2002/0147629 A1 10/2002 Alsafadi et al.
2002/0147642 A1 10/2002 Avallone et al.
2002/0152645 A1 10/2002 Darley et al.
2002/0156677 A1 10/2002 Peters et al.
2002/0165758 A1 11/2002 Hind et al.
2002/0173407 A1 11/2002 Bowman
2002/0174025 A1 11/2002 Hind et al.
2003/0009308 A1 1/2003 Kirtley
2003/0009382 A1 1/2003 D'Arbeloff et al.
2003/0009913 A1 1/2003 Potter et al.
2003/0040922 A1 2/2003 Bodin
2003/0045383 A1 3/2003 Jiminez
2003/0056401 A1 3/2003 Kwon
2003/0073526 A1 4/2003 Morrison et al.
2003/0090386 A1 5/2003 Giraldin et al.
2003/0097878 A1 5/2003 Farringdon et al.
2003/0120353 A1 6/2003 Christensen
2003/0136021 A1 * 7/2003 Pesnell ..... F26B 21/02 34/595
2003/0144095 A1 7/2003 Yang
2003/0160732 A1 8/2003 Van Heerden et al.
2003/0163287 A1 8/2003 Vock et al.
2003/0224885 A1 12/2003 Leal et al.
2004/0012524 A1 1/2004 Couronne et al.
2004/0046692 A1 3/2004 Robson et al.
2004/0064974 A1 4/2004 Schuster
2004/0162170 A1 8/2004 Ng
2004/0177531 A1 9/2004 DiBenedetto et al.
2004/0216330 A1 11/2004 Swigart
2005/0049092 A1 3/2005 Lo
2005/0080566 A1 4/2005 Vock et al.
2005/0101411 A1 5/2005 Stiller et al.
2005/0170920 A1 8/2005 Boyer et al.
2006/0014645 A1 1/2006 Yavitz
2006/0020421 A1 1/2006 Darley et al.
2006/0031039 A1 2/2006 Flentov et al.
2006/0052983 A1 3/2006 Vock et al.
2006/0135297 A1 * 6/2006 Cruciani ..... A63B 24/0021 473/570
2006/0136173 A1 6/2006 Case, Jr. et al.
2006/0156581 A1 7/2006 Holden et al.
2006/0235642 A1 10/2006 Vock et al.
2007/0006489 A1 1/2007 Case, Jr. et al.
2007/0033838 A1 2/2007 Luce et al.
2007/0037641 A1 2/2007 Wong
2008/0274844 A1 * 11/2008 Ward ..... A63B 43/00 473/570
2009/0042677 A1 2/2009 Siegel et al.
2010/0184541 A1 * 7/2010 Kessler ..... A63B 37/08 473/570
2010/0222165 A1 9/2010 Nurnberg et al.
2012/0244969 A1 * 9/2012 Binder ..... A63H 33/18 473/570
2013/0130848 A1 * 5/2013 Homsi ..... A63B 43/008 473/570
2014/0066236 A1 * 3/2014 Gamache ..... F42B 12/36 473/570

FOREIGN PATENT DOCUMENTS

CN 2211298 11/1995
DE 829109 1/1952
DE 1013126 8/1957
DE 1172585 6/1964
DE 2125758 12/1972
DE 2723625 12/1977
DE 3447171 9/1985
DE 3506055 8/1986
DE 3918038 12/1990
DE 4434889 4/1995
DE 4233341 3/1997
DE 29701308 6/1997

(56) References Cited

FOREIGN PATENT DOCUMENTS

| | | | |
|---|---|---|---|
| DE | 20004174 | | 8/2001 |
| DE | 10029456 | | 9/2001 |
| DE | 10029459 | | 9/2001 |
| DE | 10029463 | | 9/2001 |
| DE | 10029464 | | 9/2001 |
| DE | 10201134 | | 7/2003 |
| DE | 202004001492 | U1 | 4/2004 |
| DE | 20317143 | | 5/2004 |
| DE | 202004014070 | U1 | 12/2004 |
| DE | 10350300 | | 6/2005 |
| DE | 10361826 | | 7/2005 |
| DE | 102004045176 | A1 | 3/2006 |
| DE | 102005014709 | | 10/2006 |
| DE | 102008058943 | B3 | 5/2010 |
| EP | 152057 | | 8/1985 |
| EP | 219081 | | 4/1987 |
| EP | 385872 | | 9/1990 |
| EP | 472110 | | 2/1992 |
| EP | 894514 | | 2/1999 |
| EP | 1080745 | | 3/2001 |
| EP | 1120056 | | 8/2001 |
| EP | 1134555 | | 9/2001 |
| EP | 1362522 | | 11/2003 |
| EP | 1457128 | | 9/2004 |
| FR | 1488920 | | 10/1967 |
| FR | 2215249 | | 8/1974 |
| FR | 2443850 | | 7/1980 |
| FR | 2572674 | | 5/1986 |
| FR | 2667510 | | 4/1992 |
| FR | 2743701 | | 7/1997 |
| FR | 2752117 | | 2/1998 |
| FR | 2797776 | | 3/2001 |
| FR | 2806922 | | 10/2001 |
| JP | 27003908 | | 5/1952 |
| JP | 38016729 | | 8/1963 |
| JP | 54065638 | | 5/1979 |
| JP | 58215335 | | 12/1983 |
| JP | 60084689 | | 5/1985 |
| JP | 60200120 | | 10/1985 |
| JP | 01265979 | | 10/1989 |
| JP | 08252341 | | 10/1996 |
| JP | 09019516 | | 1/1997 |
| JP | 10323409 | | 12/1998 |
| JP | 3096006 | | 10/2000 |
| JP | 2001143049 | | 5/2001 |
| JP | 2001238702 | | 9/2001 |
| JP | 3091745 | | 2/2003 |
| JP | 2004016451 | | 1/2004 |
| WO | 8804768 | | 6/1988 |
| WO | 9000866 | | 2/1990 |
| WO | 9306894 | | 4/1993 |
| WO | 9311681 | | 6/1993 |
| WO | 9405177 | | 3/1994 |
| WO | 9509034 | | 4/1995 |
| WO | 9526652 | | 10/1995 |
| WO | 9717109 | | 5/1997 |
| WO | 9720449 | | 6/1997 |
| WO | 9961114 | | 12/1999 |
| WO | 0021399 | | 4/2000 |
| WO | 0033031 | | 6/2000 |
| WO | 0166201 | | 9/2001 |
| WO | 0180678 | | 11/2001 |
| WO | DM055893 | | 12/2001 |
| WO | 0234079 | | 5/2002 |
| WO | 2004018054 | | 3/2004 |
| WO | 2005044396 | | 5/2005 |
| WO | 2007130287 | | 11/2007 |

OTHER PUBLICATIONS

Response to Opposition Therm-IC Products GmbH as filed Feb. 4, 2009, 23 pages.

Adidas and Polar Introduce the World's First Completely Integrated Training System, www.Polar.com, Apr. 8, 2005, 4 pages.

U.S. Appl. No. 12/777,391, Restriction Requirement mailed on Dec. 13, 2010, 5 pages.

U.S. Appl. No. 12/777,391, Non-Final Office Action mailed on Apr. 28, 2011, 9 pages.

U.S. Appl. No. 12/777,391, Final Office Action mailed on Jan. 10, 2012, 18 pages.

U.S. Appl. No. 12/777,391, Advisory Action mailed on Mar. 23, 2012, 2 pages.

U.S. Appl. No. 12/777,391, Notice of Allowance mailed on Mar. 27, 2012, 8 pages.

European Patent Application No. 04005660.8, European Search Report mailed on Oct. 7, 2004, 6 pages.

European Patent Application No. 14153803.3, European Search Report mailed on Nov. 4, 2014, 5 pages.

International Patent Application No. PCT/US2007/009919, Search Report and Written Opinion mailed on Nov. 25, 2008, 17 pages.

International Patent Application No. PCT/US2007/009919, International Preliminary Report on Patentability mailed on Dec. 31, 2008, 10 pages.

Opposition of Therm-IC-Products GmbH as filed on Jul. 4, 2008, 20 pages.

* cited by examiner

BALL FOR A BALL SPORT

CROSS REFERENCE TO RELATED APPLICATION

This application is related to and claims priority benefits from German Patent Application No. DE 10 2013 202 485.1, filed on Feb. 15, 2013, entitled BALL FOR A BALL SPORT ("the '485 application"). The '485 application is hereby incorporated herein in its entirety by this reference.

FIELD OF THE INVENTION

The present invention relates to a ball for a ball sport.

BACKGROUND

In ball sports, such as football, tennis or golf, a ball used and its characteristics represent a significant aspect. Its size, i.e. its diameter or circumference, and its weight are examples of characteristics that belong to such a ball.

In addition, characteristics that are of importance when kicking or hitting the ball are also particularly important. These include, for example, the surface friction (the "grip") and the stiffness, elasticity, and hardness of the ball or its outer casing, where present.

During the flight of the ball through the air, further characteristics become important. These include imbalances, which could lead to an undesired "flutter" of the ball, and deviations from a spherically symmetrical distribution of mass, which could result in an undesired nutational movement, i.e. a precession. Furthermore, during the flight, the surface properties play a large role for the aerodynamic characteristics of the ball. Thus, a ball rotating in flight can follow a curved trajectory that deviates from a straight trajectory. This effect is generally described as "spin" and its force depends on the surface characteristics of the ball.

Finally, the characteristics of the ball upon impact or bounce are important. For example, a football that hits the lawn or the head of a player, is initially deformed due to its elasticity, i.e. kinetic energy that is converted into potential energy. The ball then aims to return to its original shape. Here the potential energy stored through the deformation is converted back into kinetic energy—the ball bounces off the lawn or the head of the player.

It is desirable that the ball used always exhibits the same characteristics in different external conditions. The players practicing the ball sport can then rely on the characteristics of the ball and are not surprised by changing characteristics. Among other things, this contributes to fairness and does not give the player, who has already been able to adjust to the changed characteristics, an advantage. Furthermore, the comparability of game results, which took place under different external conditions, is significantly increased if the sports device always exhibits the same characteristics.

For example, a football (i.e., soccer ball) is always to exhibit a uniform rebound, i.e. a football is always to bounce back to the same height from the same drop height on the same ground—independent of the external conditions, such as the ambient temperature for instance. It is expected of a golf ball that even at low temperatures in winter it does not harden and lose striking distance.

Weather conditions are in particular to be considered as external conditions, thus ambient temperature, humidity, air pressure and precipitation. These conditions particularly take effect in ball sports that are normally performed outside of a hall ("outdoor"), such as football (i.e., soccer), beach volleyball or golf. But different external conditions, such as ambient temperature, also occur in indoor sports ("indoor") subject to and depending on the time of year or changes in the climate zone.

It has been determined, particularly with regard to the ambient temperature, that a ball is sometimes subject to substantial fluctuations in terms of its characteristics. Thus, for example at low ambient temperatures, a football will lose its elasticity, becomes harder and does not reach its usual airspeed when kicked. Also, its surface loses its adhesion—its grip slackens and the ball will bounce badly for the player. These observations apply equally to other sports balls. For example, at low ambient temperatures, a golf ball will lose distance and its trajectory cannot be controlled by means of handling the golf club as usual, since the adhesion between golf club and golf ball has changed. Furthermore, squash balls have to be brought up to a certain operating temperature during the game via unavoidable friction losses that occur hitting before the desired bounce characteristics set in. This problem worsens at lower ambient temperatures.

A further problem relates to the risk of injury, which is combined with the changed characteristics of the ball. For example, if a ball becomes harder for a sport, then injuries are more likely to occur. A football (i.e., soccer) player for instance is more likely to suffer a head injury when performing a header if the ball is harder. Since, as described above, balls cannot be controlled as well if their characteristics change, the risk of injuring other people when kicking or hitting the ball increases. For example, a non-participant could be hit by a mishit golf ball due to altered ball characteristics.

In order to counteract the problems listed above, balls were developed using special materials, which exhibit substantially constant material characteristics throughout a temperature range that is as broad as possible. As a rule, these are plastics or special rubber mixtures from which the balls or parts of balls, e.g. bladders or panels, are manufactured.

However, these materials only insufficiently solve the underlying problem. The temperature range of substantially constant material characteristics is still considerably smaller than the temperature range in which the ball sports are generally performed. In particular, footballs (i.e., soccer balls) are lacking a satisfactory solution for temperatures under 10° C. and the balls comprising the newer materials also change their characteristics here.

It is thus an object of the present invention to provide a ball for a ball sport that does not significantly change its significant characteristics and the behavior of which therefore remains predictable for the performance of the ball sport at low ambient temperatures. According to a further aspect of the invention, the suggested solution is not to influence the principle characteristics of the ball in a disadvantageous manner, i.e. is to maintain the same characteristics as a conventional ball at moderate ambient temperatures (such as a room temperature of roughly 20° C.). According to another aspect of the invention, the ball is to be manufactured in a manner that is as cost-effective as possible.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a ball for a ball sport comprises at least one heating element.

The heating element is suitable to generate heat and to give this heat off to the ball so that a temperature of the ball, in particular that of the outer casing of the ball, increases. In certain embodiments, the temperature of the ball rises above that of the ambient temperature. Different to the prior art, the ball according to embodiments of the invention is heated to a temperature, by means of the heating element, at which the characteristics of the ball do not significantly change, i.e. the characteristics of the ball at low temperatures are not distinguishable for the player from those at moderate temperatures, such as at room temperature (20° C.). Therefore, the players of the ball sport can anticipate an unaltered behavior of the ball even at low ambient temperatures and will not be surprised by changing characteristics. The characteristics of the ball and thus its behavior remain predictable.

By providing an adequate operating temperature of the ball at low ambient temperatures, special materials are not required for the manufacture of the ball. For example, conventional materials can now be used which guarantee optimal ball characteristics in a moderate temperature range (e.g. at a room temperature of roughly 20° C.). The provision of a heating element makes the use of materials possible that do not influence the principle characteristics of the ball in a negative manner, but rather on the contrary permits a much freer choice of material than has been the case so far.

According to certain embodiments, the heating element is at least one heating wire or a wire mesh. The heating wire or the wire mesh warms up when an electrical current runs through it. A heating wire or a wire mesh is readily and cost-effectively available and easy to install. Alternatively, the heating element is a heating foil. The heating foil can, for example, comprise a flexible substrate and wires incorporated therein, which warm up upon current flow. The substrate can be self-adhesive.

In certain embodiments of the invention, the heating element is an electrically conductive fabric. Such a fabric warms up when an electrical current runs through it. Fabric is easy to process, since it can be sewn to the outer casing of the ball or a carcass, for example. Alternatively, it can also be stuck on, welded, HF-welded, or lasered. A fabric also does not significantly change the principle characteristics of a ball, in particular its elasticity, since it is flexible and yields under force. The electrically conductive fabric may, for example, be a carbon fabric or conductive cellulose.

In other embodiments of the invention, the heating element is a radiant heater, which can be easily positioned within a hollow ball, for example. By means of a steady, substantially isotropic emission of heat, a uniform heat distribution over the surface of the ball is provided. The radiant heater may be an infrared radiator. This guarantees efficient operation, since an infrared radiator merely operates in the heat radiation range of the broad spectrum of electromagnetic radiation.

The radiant heater may comprise the power source described below and the regulator described below or these can be arranged at the radiant heater.

The heating element may be arranged on the inside of the ball. The heating element is hereby protected from the considerable external force effects, which occur when the ball is used in gameplay. Damage to the heating element is avoided by this arrangement.

If, for example, the heating element is a radiant heater, said radiant heater may be arranged substantially at a geometric center of the ball. The heating element is hereby best protected from external force effects. If the heating element is furthermore a non-surface heating element, such as a radiant heater, then the arrangement substantially at the geometric center prevents the ball from having an imbalance noticeable for the player.

In additional embodiments of the invention, the heating element is a conductive polymer. Conductive polymers are plastics with electrical conductivity and warm up upon current flow. Conductive polymers can easily be brought into the desired shape and applied on to the bladder of a ball as a film. A conductive polymer may also be an integral part of the outer casing of a ball. But a conductive polymer may also be arranged on the inside of a bladder of the ball, between a carcass and a bladder of a ball, within a carcass and between a carcass and panels.

According to some embodiments of the invention, the ball is inflatable. For example, the ball can be a football (i.e. soccer ball), (beach) volleyball, basketball, rugby ball or American football. As a rule, inflatable balls are filled with air or filler gas and are charged with overpressure. Due to its thermal conductivity, the air or the filler gas can in addition provide for a substantially, i.e. with regard to the characteristics of the ball, even distribution of the heat generated by the heating element.

In certain embodiments, the ball has a bladder in its interior and the heating element is arranged on the bladder. The arrangement of the heating element on the bladder is advantageous, since the heating element can hereby be accommodated within the ball in a very easy fashion. Since a bladder is typically provided with inflatable balls, the accommodation of the heating element occurs in conjunction with a pre-existing production step, namely the insertion of the bladder. In addition, conventional balls can be easily provided with a heating element in this manner, in that a bladder correspondingly provided with a heating element is inserted into the casing of the ball. The casing of the ball may be manufactured with conventional materials. In some embodiments, a ball may be retrofit with a bladder that has been provided with a heating element.

The heating element may be arranged in the inside of the bladder, i.e. on the side facing the center of the ball. The heating element may thus be easily connected with a power source arranged for example in the center of the ball, without the need for implementations to be provided for electrical conductors. Alternatively, the heating element may also be arranged on the outside of the bladder, i.e. on the side which faces away from the center of the ball. The heating element is hereby closer to the surface of the ball, which causes a faster and more efficient heat transmission to the outer casing.

In certain embodiments of the invention, the heating element is a heating wire that is vapor-deposited or imprinted on the bladder or a wire mesh that is vapor-deposited or imprinted on the bladder. Such heating elements effectively convert electrical current into heat and are easy to manufacture. Vapor-depositing or imprinting heating wires or wire mesh represents a cost-effective opportunity to arrange a heating element on the bladder. If the heating element is a heating foil, as set out above, said heating foil may be stuck, welded, HF-welded, lasered or sewn onto the bladder. Heating foil is relatively cost-effective, easy to obtain, since it finds application in numerous other areas, and can be easily processed, in particular through sticking, lasering, welding, HF-welding, or sewing.

A bladders for an inflatable ball with an electric wiring, which can for example be a heating wire or a power source in the sense of the application at hand, are discussed in DE 10 2008 058 943 B3 of the Applicant, the entire contents of which is incorporated herein by reference.

If the heating element is a radiant heater, as set out above, then said radiant heater may be arranged within the bladder, in particular substantially at the geometric center of the bladder. As set out above, imbalances of the ball are avoided in this manner. In certain embodiments, the radiant heater is then at least fixed on a fixing element, which is connected with the bladder. The radiant heater is hereby held in the geometric center of the ball. The fixing element may then simultaneously serve as an electrical feed for the power supply or as a mount for the feed of the power supply of the heating element.

The ball may also have a carcass, which serves as the stabilization of the ball. In this case, the heating element may also be arranged at the carcass. The heating element may hereby be easily inserted into the ball together with the carcass. If the heating element is located on the outside of the carcass, then the heat generated by the heating element is quickly and effectively transported to the outer casing and brings it to the desired temperature.

In case the ball has several layers of carcass, the heating element may also be arranged between two layers of carcass. The heating element is hereby protected by the outer carcass layer from exterior forces while it is held in its position by the inner carcass layer.

In additional embodiments of the invention, the heating element is arranged within the outer casing of the ball. The heat generated by the heating element is hereby released directly where it is required, because particularly the temperature of the outer casing is of central importance for the characteristics of the ball. Through the arrangement of the heating element in the outer casing, said casing is quickly brought to the required temperature and the loss of heat within the ball is low.

The outer casing may have panels, and the heating element is arranged in at least one panel. Panels permit the outer casing of the ball to be manufactured out of individual elements in suitable arrangement (for instance pentagons and hexagons). The arrangement of a heating element in at least one panel permits an easy mounting of the heating element in the outer casing.

In other embodiments, a heating element can be assigned to several panels or one on each panel and the panels can be connected such that an electrical connection between the heating elements occurs, in order to supply the heating elements with electrical current. This arrangement permits a simple combination of the individual heating elements without the need to additionally connect said elements between themselves in a further production step. For example, the panels may have electrically conductive contact surfaces, which establish an electrical connection between to panels upon contact. The electrically conductive contact surfaces may be designed such that they interlock with one another, in order to guarantee a secure electrical contact. Alternatively, the panels can be connected by means of a wire.

There may be a cushioning material, such as foam, in which the heating element is arranged. A cushioning material, such as foam, provides the reinforcement of the outer casing. Through the arrangement of the heating element in the cushioning material, the heating element is better protected from exterior forces. The cushioning material may also be a fleece, a 3D-material or an air cushion. Thus, any appropriate material with sufficient cushioning characteristics may be used.

In certain embodiments, the ball has a valve which has a first end that is arranged outside the outer casting of the ball and a second end that is arranged within the outer casing of the ball, whereby the heating element is arranged at the second end of the valve. The valve permits the ball to be charged with a desired overpressure by means of a pump. The valve may easily be provided with a heating element, a radiant heater for instance. Thus, the ball may be provided with a heating element in a single production step, namely the affixing of the valve.

A depletion layer for heat insulation may be arranged at the side of the heating element that faces the geometric center of the ball. This prevents heat being unnecessarily emitted into the interior of the ball, where it is not required and/or that the ball emits too much heat and/or too quickly to the environment. The depletion layer may be a heat insulating foil. This is cost-effective and easy to process.

In certain embodiments, the ball has at least one electric power source, which provides an electrical current for heating the heating elements and with which it is electrically connected. The power source delivers current during the use of the ball, for instance in a game of football, in order to maintain the ball at the necessary temperature, which guarantees substantially unaltered characteristics of the ball. In this way, the ball maintains its temperature and thus its desired characteristics throughout the entire game. Cooling of the ball during the game is thus avoided.

The power source is a battery and/or a rechargeable electric accumulator.

In other embodiments, the power source is arranged substantially opposite the valve of the ball, or in the geometric center of the ball. This arrangement reduces or avoids a possible imbalance, which would lead to an undesired "flutter" of the ball in flight. The masses of the valve and the heating element cancel each other out approximately—ideally entirely.

In certain embodiments, the power source is a battery or an accumulator battery, which may be designed as at least one foil that can be arranged at the bladder. On the one hand, such an arrangement has the advantage that only a slight imbalance occurs, because the mass of the power supply can be spread evenly across larger areas of the bladder. On the other hand, this more even arrangement leads to the fact that the distribution of the mass of the ball is substantially spherical, so that imbalances or deviations from a spherically symmetrical mass distribution are reduced or avoided.

According to some embodiments, the ball comprises an electrical connector or an electric socket, via which the ball can be connected to an external power supply, in order to charge the power source. For example, an accumulator arranged in a ball in this manner can easily be charged via an existing wall socket by means of a suitable charging device prior to the use outdoors. The connector or the socket can be e.g. a jack, XLR, USB, mini-USB or micro-USB.

In certain embodiments, the power source is charged by means of electromagnetic induction. This arrangement has the advantage that the power source can be charged wirelessly and no electrical connection of the ball needs to be provided on its outer casing.

In these embodiments, the ball may comprise an electric coil that is connected to the power source and is suitable to extract energy from an electromagnetic field and to provide the energy to the power source as a charging current. A coil can be easily attuned to an electromagnetic alternating field and thus permits a power transmission that is substantially without loss.

In other embodiments, the ball comprises at least one electric generator, which is configured to convert rotational energy and/or kinetic energy of the ball into current, which can be fed to the heating element and/or the power source. In this way, the heating element and/or the power source is provided with current during the game only by means of the motion and/or rotation of the ball that is already in existence. In some embodiments, an additional transmission of energy prior to the game may then no longer be required. The handling of the ball does not differ, or only insignificantly, to the handling of an ordinary ball. But the ball according to embodiments of the invention maintains its characteristics even at low temperatures.

The generator may be connected to an accumulator for example. The accumulator could be charged before the game, e.g. by means of electrical induction, and thus provides the heating element with electrical current from the beginning of the game. During the game, the generator may provide the accumulator with electrical current and/or instead of or in addition to the accumulator providing the heating element with electrical current.

In other embodiments, the ball comprises at least one piezoelectric element which is suitable to convert mechanical force acting upon it into current, which can be fed to the heating element and/or the accumulator. It is hereby also guaranteed that the ball is provided with power through the kicks and hits already being performed on the ball.

According to certain embodiments, the piezoelectric element is arranged on the bladder of the ball, such as on the inside of the bladder or on the outside of the balder. This arrangement permits a simple manufacture, since the piezoelectric element can be easily affixed on the bladder and be inserted into the ball together with the bladder in one production step. But piezoelectric element may also be arranged on a carcass or within a carcass layer of the ball. The arrangement in relative proximity to the surface of the ball permits an effective conversion of force impacts into electrical energy.

In some embodiments, at least one electrical connection between the heating element and the power source runs through the valve of the ball. In this way the electrical connection can, for example, be passed through the bladder without the need for a special feedthrough for the electrical connection.

In additional embodiments, at least one electrical connection between the heating element and the power source runs through a connecting element that is arranged within the bladder. The connecting element can, for example, connect and hold a power source that is arranged substantially in the geometric center of the bladder with the bladder. The electrical connection may, for example, be an electrically conductive wire, which runs along said connecting element and can be guided safely in this manner.

A bladder with reinforcing surfaces, which extend into the inside of the bladder and represent connecting elements in the sense of the application at hand, is described in DE 10 2004 045 176 B4 of the Applicant, the entire contents of which is incorporated herein by reference.

In certain embodiments of the invention, the ball further comprises a regulator, which is suitable to regulate the current for heating the heating element in such a manner that a temperature of the ball substantially adopts a predetermined value. This predetermined value is chosen such that it coincides with the temperature point, below which the characteristics of the ball worsen. In this manner, the ball maintains its characteristics, which it exhibits at moderate temperatures (e.g. 20° C.), even at low ambient temperatures. The temperature of the ball thereby does not need to adopt the predetermined value exactly, but rather substantially, so that the characteristics of the ball do not change in a manner that is noticeable for the player. Thus, the temperature may fluctuates around the predetermined value and, for example, distances itself from the predetermined value by e.g. ±3° C. in certain time intervals, then approach the predetermined value again.

A regulator may comprise e.g. a CPU, which regulates the temperature of the ball with a preprogrammed algorithm via the heating element. The regulator may be programmed by the user and individual parameters, such as the target temperature and/or the duration of heat emission, may be set through the heating element.

The regulator may be programmed from outside via a cable (e.g. USB). The regulator may also be programmed wirelessly e.g. via WLAN, Bluetooth, Bluetooth LE, NFC or RFID. The regulator may be programmed by a user via a computer, a smartphone or a tablet computer.

In some embodiments, a control unit may be used instead of a regulator.

The regulator may regulate the current provided to the heating element from the power source. For this, the regulator is connected between the power source and the heating element.

In other embodiments of the invention, the predetermined value ranges between 5° C. and 15° C., and may further range between 8° C. and 12° C., and may even further be approximately 10° C. It has been established that the characteristics of a sports ball significantly change at temperatures below a range between 5° C. and 15° C.

In some embodiments, the regulator constantly regulates the current provided to the heating element from zero to the maximum available current from the power source. For example, the regulator may regulate the power supply of the heating element in a range from and including 0 ampere up to an including 1 ampere. Other ranges are also possible. The range is typically chosen based on the operating voltage of the power supply and the electric resistance of the heating element.

In certain embodiments, the regulator regulates the current provided to the heating element such that a temperature of the ball remains temporally constant. For example, the temperature may be measured at the ball, or in the filler gas, or rather the air filled in. In certain embodiments, the temperature of the ball held constant by the regulator is sufficiently high that the characteristics of the ball change insignificantly at most in comparison to a reference temperature (for instance the room temperature of 20° C.).

According to some embodiments, the regulator is a switch that is configured to automatically switch on the current for heating the heating element when the temperature of the ball drops below a first predetermined threshold value, and to automatically switch the current off when the temperature of the ball rises above a second predetermined threshold value.

Such a switch can be easily implemented as an electronic comparator which compares the temperature of the ball converted into a voltage as an actual value with the predetermined value, also converted into a voltage, as a set value.

In some embodiments, the first threshold value is smaller than the second threshold value. Therefore, the switch comprises a hysteresis, which prevents the switch from constantly switching on and off.

In other embodiments, the temperature is a temperature of a filler gas of the ball or a temperature of the outer casing of the ball. The temperature of the filler gas may be easily measured by means of a conventional temperature sensor, for instance a so-called Negative Temperature Coefficient Thermistor (NTC thermistor). The temperature of the outer casing may also be measured by means of a conventional temperature sensor. The use of outer casing temperature has the advantage that a response can be made directly in connection with a fall in the temperature of the outer casing, where the characteristics of the ball are substantially determined, in that the regulator correspondingly regulates the current. In certain embodiments, the filler gas is air.

In other embodiments of the invention, the regulator is connected with a pressure sensor, which measures the interior pressure of the ball. For instance, if the interior pressure falls below a certain threshold value, the regulator may cause the heating element to heat up the air or the filler gas in the interior of the ball, in order to increase the interior pressure of the ball.

The regulator may be arranged within the bladder. This arrangement reduces the influence of the mass of the regulator on the moments of inertia of the ball, reduces imbalances, and benefits an approximate spherically symmetrical distribution of mass.

Alternatively, the ball may comprise several bladders and the heating element and/or the power source and/or the regulator are arranged between bladders. These elements may thus be held in their positions comparatively easily and are well protected against external forces.

In other embodiments of the invention, the heating element and/or the power source and/or the regulator are arranged in such a manner that a center of mass of the ball substantially coincides with the geometric center of the ball. Bodies turn around their center of mass in flight. The approximate coincidence of center of mass and geometric center reduces or avoids that the ball exhibits an imbalance which would lead to an undesired "fluttering" of the ball in flight, or to an irregular rolling behavior on the floor.

In other embodiments of the invention, the heating element and/or the power source and/or the regulator are arranged in such a manner that the distribution of mass of the ball is substantially spherically symmetrical. A body has three moments of inertia about three orthogonal space axes. A body with a perfect spherically symmetrical distribution of mass therefore has three equal moments of inertia along three orthogonal space axes. A body which does not exhibit three equal moments of inertia, can perform precession (the so-called nutational movement) in addition to its rotational movement. In a sports ball, such precession leads to undesired "wobbling" of the ball in flight. The arrangement of the heating element and/or the power system and/or the regulator so that the distribution of mass of the ball is substantially spherically symmetric, thus avoids or reduces the undesired precession, since the three moments of inertia of the ball are substantially equal.

BRIEF DESCRIPTION OF THE DRAWINGS

In the following detailed description, embodiments of the invention are described referring to the following figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following detailed description, certain embodiments of the invention are described with reference to a ball for a ball sport. The ball sport can be football (soccer), (beach) volleyball, basketball, tennis, golf, rugby or American football. However, the invention is not limited to these ball sports and can find application for balls of other ball sports.

Figure 1:
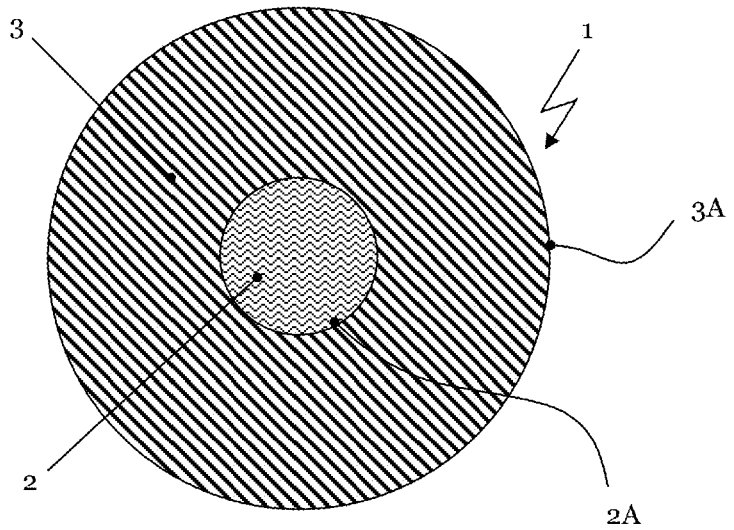
FIG. 1 is a schematic overall representation of a heating element arranged in an interior of a ball, according to certain embodiments of the present invention.

FIG. 1 illustrates a schematic overall representation of a ball 1 according to certain embodiments of the present invention. A heating element 2 is arranged in an interior region 2A of the ball 1. The heating element 2 is suitable to generate heat and to give off this heat to the ball 1, so that the temperature of the ball 1 increases. In some embodiments, the temperature of the ball 1 rises above the ambient temperature. The heating element 2 can, for instance, be operated electrically and be able to convert electrical current into heat. For example, the heating element 2 can be, but is not limited to, one or more heating wires or a wire mesh.

In certain embodiments, the heating element 2 is a latent heat storage system. This comprises a phase change material ("PCM") which delivers thermal energy upon a phase transition. The phase transmission solid-liquid is used most commonly here. Upon heating, the phase change material absorbs thermal energy via its melting point in the form of melting heat. Since the phase transition is reversible, the phase change material releases precisely the melting heat upon solidification. This heat can be used in order to supply the ball 1 with heat energy over a longer period of time.

In additional embodiments, the heating element 2 may also be a conductive polymer. Conductive polymers are synthetics with electrical conductivity and heat up upon current flow. Examples of conductive polymers are polyacetylene, polyaniline and polyparaphenylene. Conductive polymers can easily be brought into the desired shape and, for example, applied as a film. For example, an electrically conductive polymer may be applied to a bladder 4 of the ball 1 as a film. A conductive polymer may also be an integral part, e.g. of an outer casing 5 of the ball 1.

As shown in FIG. 1, the ball 1 may be filled with a material suitable as a filler 3, in order to hold the heating element 2 in its position. For example, the ball 1 may be filled with foam, a similar filler, or other cushioning material as a filler 3. In other embodiments, the ball 1 may be configured so that it is not fillable, such as where the ball 1 is made of solid material, such as a golf ball. In this case, a recess is provided in the interior region 2A of the ball 1, which receives the heating element 2.

The filler 3 or the solid material simultaneously serves as a heat conductor to conduct the heat generated by the heating element 2 from the interior region 2A of the ball 1 to its surface 3A and makes sure that the ball 1 is heated evenly at the surface 3A, as well as the underlying layers where applicable. As a result, the heat conduction provided by the filler 3 or the solid material ensures that, at low ambient temperatures, the temperature of the ball 1 is prevented from falling so low that the characteristics of the ball 1 are influenced negatively and in an unpredictable manner.

The filler 3 or the solid material may also provide cushioning to the ball 1. When practicing ball sports, balls are generally exposed to great acceleration forces. For example, a golf ball can reach relatively high speeds within a fraction of a second after teeing off. A football can also reach speeds of well over 100 km/h within a short period of time when kicked. The heating element 2 can be protected from these high accelerations by the surrounding filler 3 or the surrounding solid material. The filler 3 or the solid material may therefore be formed of materials having elastic and/or cushioning properties and/or having other properties that absorb the external forces.

Figure 2:
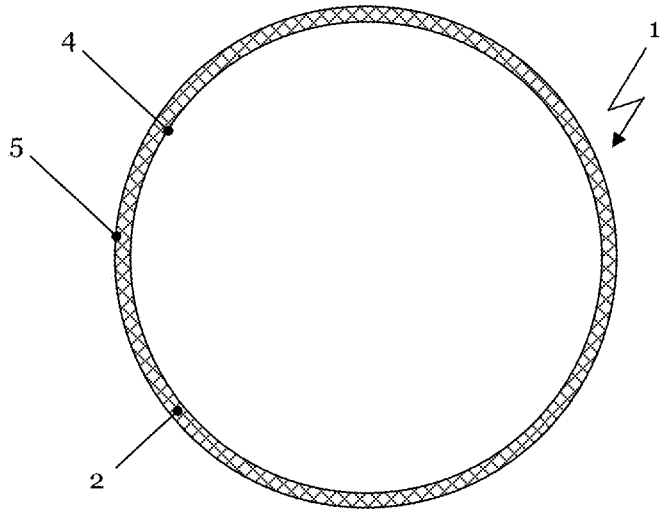
FIG. 2 is a schematic overall representation of a heating element arranged at the bladder of an inflatable ball, according to certain embodiments of the present invention.

FIG. 2 shows a schematic overall representation of additional embodiments of the present invention, in which the heating element 2 is arranged at a bladder 4 of an inflatable ball 1. Inflatable balls normally comprise a bladder 4 that is located in their interior, which is airtight or gastight and can be charged with over pressure via a valve 8 (not shown in FIG. 2). The bladder 4 is normally arranged within an outer casing 5, which confers the necessary stability to the ball 1 and protects the substantially fragile bladder 4 from damage that may otherwise result from external forces that are applied to the ball 1.

In these embodiments, as illustrated in FIG. 2, the heating element 2 is arranged on the outside (i.e. the side facing away from the geometric center of the ball 1) of the bladder 4. The heating element 2 is therefore located between the outer casing 5 and the bladder 4. Through this arrangement, the heating element 2 can give off heat both to the bladder 4 as well as directly to the outer casing 5, which allows the heating element 2 to quickly and efficiently heat the components of the ball 1 that are of importance for the characteristics of the ball 1.

In the embodiments illustrated in FIG. 2, the heating element 2 may be, but is not limited to, an electrically conductive fabric, a heating foil, a conductive polymer, or a wire mesh. The heating element 2 may be connected to the bladder 4, for example by being stuck, sewn, or welded on. In some embodiments, the heating element 2 may be vapor-deposited or imprinted onto the bladder 4 as a heating wire or wire mesh.

In some embodiments, the heating element 2 may also be arranged on the inside (i.e. the side facing the geometrical center of the ball 1) of the bladder 4. In these embodiments, the heating element 2 may be, but is not limited to, an electrically conductive fabric, a heating foil, or a wire mesh. The heating element 2 may be connected to the bladder 4, for example by being stuck, sewn, or welded on. In some embodiments, the heating element 2 may be vapor-deposited or imprinted on the inside of the bladder 4 as a heating wire or wire mesh.

In other embodiments, the heating element 2 may also be connected with the outer casing 5 of the ball 1. In other words, the outer casing 5 of the ball 1 comprises the heating element 2. In such cases, the ball 1 may also be a bladderless ball, the outer casing 5 of which is airtight or gastight. The heating element 2 may be connected with the outer casing 5 (inside or outside) in the same manner as described above in relation to the bladder 4.

The heating element 2 may also be integrated directly into the outer casing 5. For example, the outer casing 5 of the ball 1 may be made of panels (not shown in the figures), such as a football (i.e., soccer ball) for example, the outer casing 5 of may be made of pentagonal and hexagonal panels. The heating element 2 may then be integrated into at least one panel, for example as a heating wire, wire mesh, or electrically conductive fiber. Furthermore, in certain embodiments, the heating element 2 may be integrated into a plurality of panels, wherein the panels are connected to form an electrical connection 11 (not shown in FIG. 2) between the heating elements 2 of adjacent panels.

To form the electrical connections between the heating elements 2 adjacent panels, the panels may comprise electrically conductive contact surfaces, which establish the electrical connection 11 between the panels upon contact. The electrically conductive contact surfaces may be designed so that they e.g. interlock with one another, in order to guarantee a secure electrical contact. Alternatively, the panels can be connected by means of a wire.

Figure 3A:
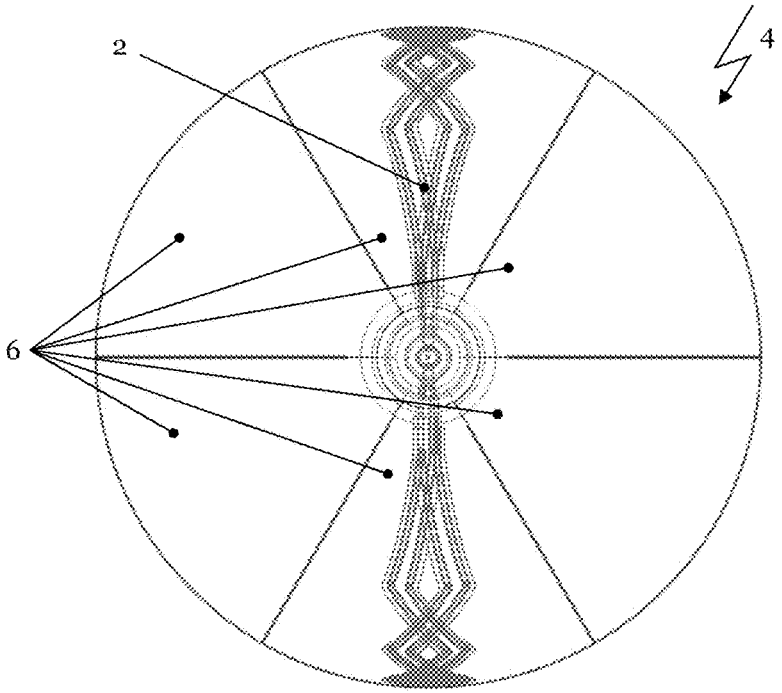
FIG. 3*a* is a top view of the bladder arranged in the inflatable ball of FIG. 2.

FIG. 3*a* shows a top view of a bladder 4 arranged within the ball 1, according to certain embodiments of the invention, as illustrated in FIG. 2. In these embodiments, the bladder 4 comprises six individual segments 6, which may be welded airtight or gastight. The bladder 4 may also be designed as a single piece. In these embodiments, as illustrated in FIG. 3*a*, heating wires 2 may be positioned on the surfaces of and/or within two of the segments 6. These heating wires 2 comprise the heating element 2. The heating wires 2 are configured with a substantially zigzag pattern. With such a pattern, excessive tensile strain on the heating wires 2 is therefore avoided, even with severe deformation of the ball 1 or insufficient air pressure of the bladder 4. The heating wires 2 may run along the outside or the inside of the bladder 4 and may be vapor-deposited or imprinted on the bladder 4. Instead of being positioned on the surfaces of and/or within two segments 6, the heating wires 2 may be positioned on the surfaces of and/or within several segments 6, for example along all segments 6, to provide uniform heat dissipation across the surface 3A of the bladder 4. In other embodiments, the heating wires 2 may be positioned on the surfaces of and/or within any suitable number of segments 6, including but not limited to any even or odd combination of segments 6, such as 1, 3, 4, or 5 segments 6.

Figure 3B:
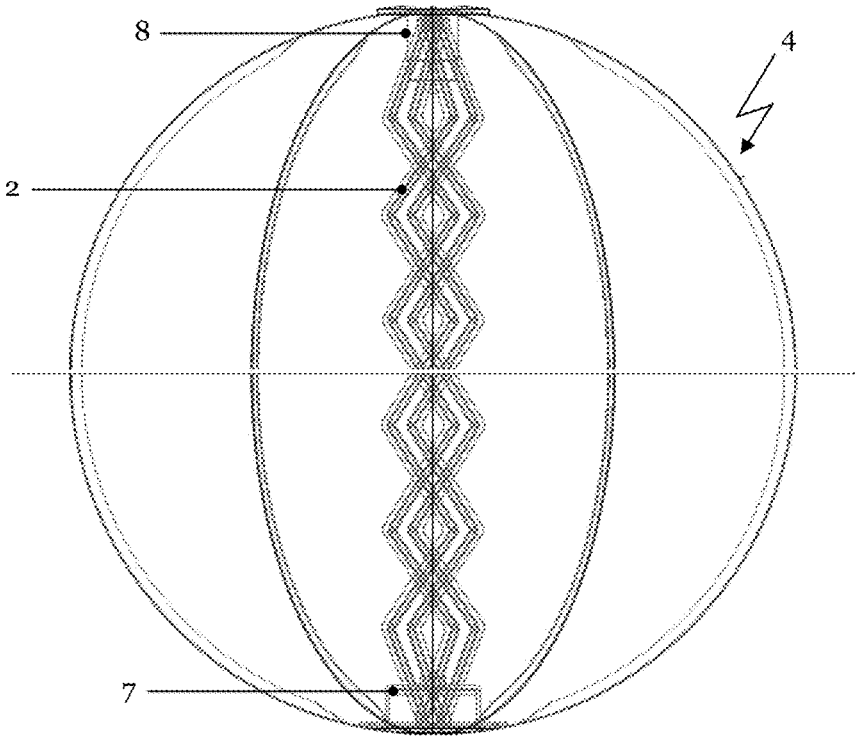
FIG. 3*b* is a side view of the bladder arranged in the inflatable ball of FIG. 2.

FIG. 3*b* shows a side view of a bladder 4, which is arranged within a ball 1, according to certain embodiments of the invention, as illustrated in FIG. 2. Here, the zigzag pattern of the heating wires 2 is particularly visible. Furthermore, a power source 7 is shown in FIG. 3, which is arranged within the bladder 4. The power source 7 is electrically connected to the heating wires 2 and provides the heating wires 2 with electrical current. The power source 7 is arranged opposite a valve 8 arranged on the bladder 4. The bladder 4 can be charged with over pressure via the valve 8. The opposing arrangement of power source 7 and valve 8 is used to counterbalance the respective weights so that the center of mass of the ball 1 substantially coincides with the geometric center of the ball 1, so that the ball 1 does not exhibit any or only a slight imbalance. The arrangement of the heating wires 2 on the opposing segments 6 of the bladder 4 also contributes to the relative alignment of the center of mass of the ball 1 and the geometric center of the ball 1.

A charge level indicator may also be arranged at the valve 8, which indicates the charge level, i.e. the remaining electrical energy, of the power source 7. The charge level indicator may be an optical indicator, which comprises light emitting diodes ("LEDs"), for example. It may also be an acoustic charge level indicator, for instance a loud speaker or buzzer, which emits an acoustic signal when the charge level drops below a predetermined threshold charge level.

Figure 6:
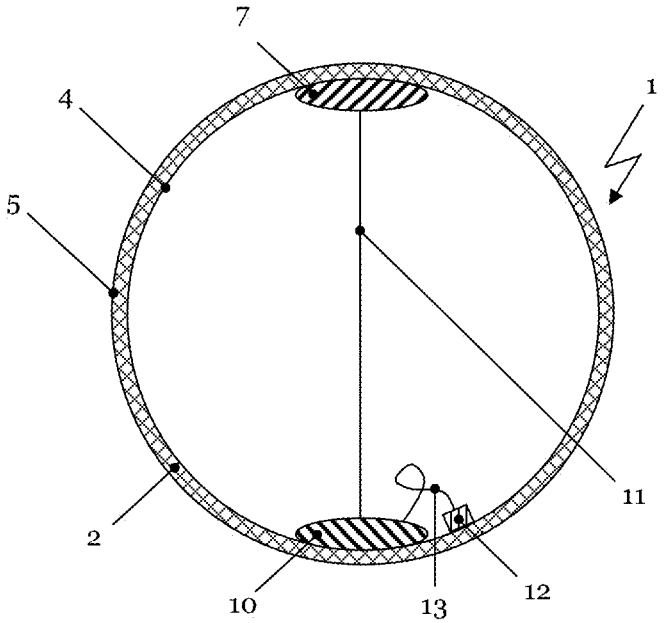
FIG. 6 is a schematic overall representation of a heating element, a power supply, and a switch arranged in an inside of a bladder of a ball, according to certain embodiments of the present invention.

In addition, the ball 1 shown in FIG. 3*b* may also comprise a regulator 10 (or a control unit), as illustrated in FIG. 6. The regulator 10 may be arranged at the valve 8 or the power source 7 for instance, depending on what is more favorable for a balanced distribution of mass of the ball.

Figure 4:
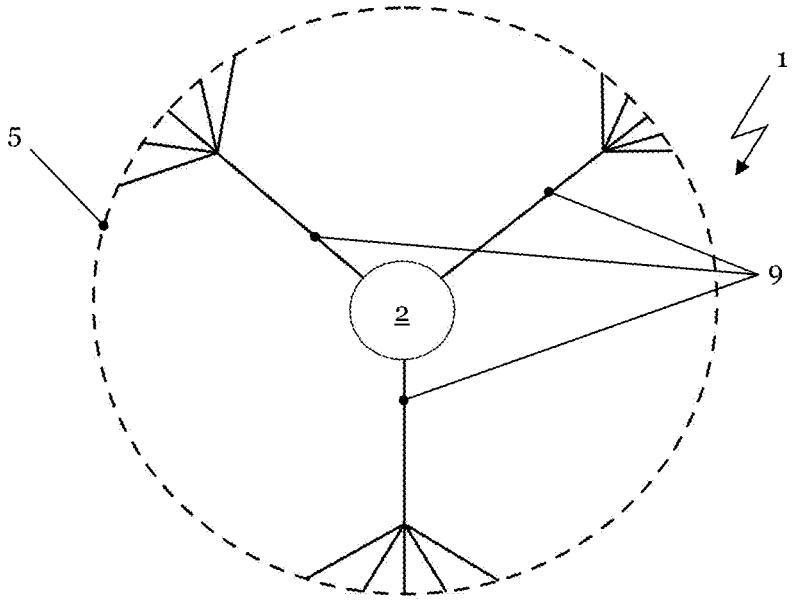
FIG. 4 is a schematic overall representation of a heating element hung on connecting elements on an inside of a ball, according to certain embodiments of the present invention.

FIG. 4 shows a schematic overall representation of other embodiments of the present invention in which the heating element 2 is coupled to connecting elements 9 in the interior of the ball 1, according to certain embodiments of the invention. The connecting elements 9 hold the heating element 2 in position proximate the geometrical center of the ball 1. The suspension of the heating element 2 ensures that no shearing stress acts upon the heating element 2. Fewer or greater numbers of connecting elements 9 may be used instead of the three connecting elements 9 shown in FIG. 4. In these embodiments, the connecting elements 9 are directly connected with the outer casing 5, and the ball 1 does not comprise a bladder 4.

The connecting elements 9 themselves, illustrated in FIG. 4, may also serve as heating wires 2 that heat the ball 1 when current is flowing therethrough. Alternatively, heating wires 2 may also be positioned along the connecting elements 9. In other embodiments, the connecting elements 9 are electrically conductive and provide the power supply 7 for the heating element 2, or the electric conductors that supply the heating element 2 with power from the power source 7 are positioned along the connecting elements 9.

A regulator 10, which e.g. regulates the power supply 7 for the heating element 2, may principally be arranged at the heating element 2 in the various embodiments. In certain embodiments, a control unit may be used instead of a regulator 10. The regulator 10 or the control unit may comprise a CPU and a memory, so that a regulation or control algorithm can be executed. This can be a micro controller, on which the CPU and memory are integrated.

A receiver, such as a radio module via which control commands for regulation and/or control of the heating elements 2 may be received, can principally be arranged at the heating element 2 in the various embodiments.

Furthermore, a power source 7 that provides the heating element 2 with electrical current can principally be arranged at the heating element 2 in the various embodiments.

Figure 5:
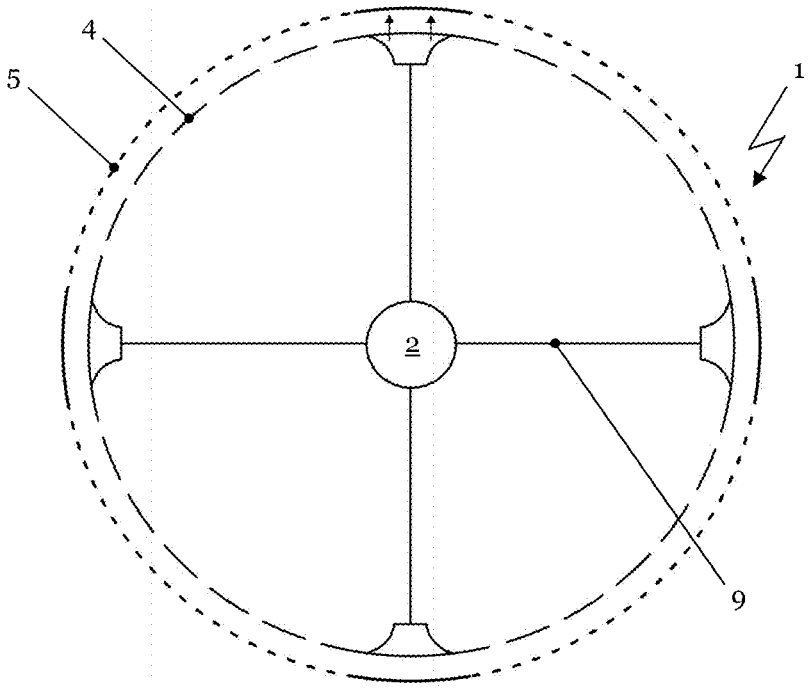
FIG. 5 is a schematic overall representation of a heating element arranged in an inside of a bladder of a ball, according to certain embodiments of the present invention.

FIG. 5 shows a schematic overall representation of other embodiments of the present invention in which the heating element 2 is located in the interior of the bladder 4 of a ball 1, according to certain embodiments of the invention. In these embodiments, the ball 1 comprises the bladder 4, which is arranged within the outer casing 5. The heating element 2 is held in position by means of four connecting four connecting elements 9 shown in FIG. 5.

The connecting elements 9 themselves, illustrated in FIG. 5, may also serve as heating wires 2 that heat the ball 1 when current is flowing therethrough. Alternatively, heating wires 2 may also be positioned along the connecting elements 9. In other embodiments, the connecting elements 9 are electrically conductive and provide the power supply 7 for the heating element 2, or that electric conductors that supply the heating element 2 with power from the power source 7 are positioned along the connecting elements 9.

FIG. 6 shows a schematic overall representation of additional embodiments of the present invention, in which the power supply 7 and the regulator 10 are shown in addition to the heating element 2.

The regulator 10 regulates the power supply 7 of the heating element 2 between 0 ampere and 1 ampere, for example. The regulator 10 may be a continuous regulator 10, which regulates the current in a steplessly variable, or almost steplessly variable manner. The regulator 10 processes a measured temperature of the ball 1 as an input variable (also known as a control variable) and regulates the amperage of the current provided to the heating elements 2 as an output variable (also known as actuating variable). The regulator 10 constantly strives to set the amperage such that the measured temperature substantially evens out at a specific, predetermined value (also known as set point). The regulator 10 detects deviations from the predetermined value and counterbalances it.

The preset value of the temperature, i.e. the target temperature, to which the regulator 10 is configured to adjust the temperature of the ball to match, may be set ex works. Alternatively, the user may set this value, for example via a switch 10 on the ball, e.g. at the valve 8. The user may set the value before, during, or after the use of the ball. In certain embodiments, the user may connect a cable, e.g. a USB cable, to the ball and then connect the ball with a computer, a smartphone, or a tablet computer, wherein the target temperature may be set by means of suitable software. In other embodiments, the ball may equipped with a radio module, for example a Bluetooth, Bluetooth low energy ("Bluetooth LE"), wireless local area network ("WLAN"), radio-frequency identification ("RFID") or near field communication ("NFC") module, so that the ball can communicate with an external device, such as a computer, a smartphone or a tablet computer. For instance, the ball could communicate a temperature, a pressure, or a charge level in this manner.

If the measured temperature is, for example, smaller than the preset value, then the regulator 10 increases the amperage provided to the heating element 2. Correspondingly, the heating element 2 gives off a greater heat quantity. The temperature of the ball 1 increases and with it rises the measured temperature, which is processed by the regulator 10.

If the measured temperature is above the preset value, then the regulator 10 reduces the amperage provided to the heating element 2. The heating element 2 gives off a lower heat quantity and the temperature of the ball 1 is lowered.

Since the measured temperature follows the changes of the amperage slowly, the regulator 10 must react to the deviations in such a manner that the preset value is substantially reached as fast as possible, while also avoiding an "overshot" and thus an excessive oscillation around the set point.

This goal is met, for example, by a so-called PID controller. The PID controller comprises three regulating parts, which respectively react differently to deviations. The P part (proportional controller) regulates the actuating variable proportionally to the deviation of the control variable from the set point. The I part (integral controller) integrates the deviation of the control variable over time and adjusts the actuating variable according to this integral. The D part (differential controller) sets the actuating variable corresponding to the slew rate of the deviation of the control variable. The three parts can be combined in parallel or series connection and thus result in a very adaptable regulator 10.

A discontinuous regulator 10, such as a switch 10, can be used instead of a constant regulator 10. A switch 10 switches the power supply 7 for the heating element 2 on with the maximum current provided by the power source 7 when the measured temperature drops below the preset value. Correspondingly, a switch 10 switches the power supply 7 off when the measured temperature rises above the preset value. The switch 10 thus activates the heating element 2 and could also be described as an activator.

In certain embodiments, the ball 1 (as shown in FIG. 6) comprises an outer casing 5 and a bladder 4 arranged therein. A heating element 2 is arranged between the bladder 4 and the outer casing 5. Alternatively, as set out above, the heating element 2 may also be arranged on the bladder 4 or on the outer casing 5 or integrated, vapor-deposited, or imprinted therein and/or thereon. The heating element 2 may, as set out above, be a heating wire, a wire mesh, a conductive polymer, or a heating foil. A power supply 7 is arranged on the inside of the bladder 4, which supplies the heating element 2 with power. The connection between the power supply 7 and the heating element 2 can, for example, occur along a valve 8 (not shown in FIG. 6) in the shape of wires or cables (not shown in FIG. 6).

A regulator 10 is arranged opposite the power source 7. The regulator 10 is connected to the power source 7 via an electrical connection 11. This connection may, for example, be one or more wires or cables. The regulator 10 regulates the current entering the heating element 2 via the electrical connection 11.

In other embodiments, the regulator 10 and the power source 7 are arranged on the same side of the ball 1 and a counterweight is arranged on the opposing side in order to avoid an imbalance of the ball 1. Principally, a counterweight may be used in any of the embodiments of the invention shown herein, in order to avoid an imbalance of the ball 1.

In some embodiments, the electrical connection 11 is a wire, wherein the regulator 10 is electrically connected to the heating element 2 and thus regulates an electrical circuit that runs through the heating element 2. The closed electrical circuit runs from one pole (e.g. "+") of the power source 7 via the heating element 2 to the regulator 10 and from it to a different pole (e.g. "−") of the power source 7 via the electrical connection 11. When the regulator 10 regulates the current entry to zero, the electrical circuit is interrupted and current no longer flows, so that the heating element 2 is no longer provided with power. In the embodiments wherein the regular 10 is the switch 10 (i.e., a discontinuous regulator 10), the connection between the switch 10 and the heating element 2 may, for example, occur along a valve 8 (not shown in FIG. 6) in the shape of wires or cables (not shown in FIG. 6).

The regulator 10 may be connected with a temperature sensor 12 via an electrical connection 13. The temperature sensor 12 may, as shown in FIG. 6, be arranged at the bladder 4 and measure the temperature of the bladder 4 or the temperature of the filler gas. Alternatively, the temperature sensor 12 may be directly integrated in the regulator 10 and not formed as a separate component part.

Alternatively, instead of a temperature sensor 12, it can also be a pressure sensor, which measures the internal pressure of the ball. For example, if the internal pressure falls below a certain threshold value, then regulator 10 may cause the heating element 2 to heat up the air or the filler gas in the interior of the ball, in order to increase the internal pressure of the ball.

In certain embodiments, the temperature sensor 12 may, for example, be a thermistor. This is a resistor, whose resistance has a negative temperature coefficient, i.e. that it conducts electrical current better at higher temperatures than at low temperatures. Such behavior is demonstrated by semiconductors, compound semiconductors, and certain alloys.

In some embodiments, temperature sensor 12 may be a pyrometer, which is also described as being a radiation thermometer. It enables a non-contact determination of the temperature of an object by means of measuring the intensity and position of the emission peak of the heat radiation given off by the object. In these embodiments, as illustrated in FIG. 6, a pyrometer could thus perform a non-contact measurement of the temperature of the inside of a bladder 4.

In these embodiments, the switch 10 is arranged opposite the power source 7. An imbalance of the ball 1 is hereby avoided or at least reduced, since the center of mass of the ball 1 substantially coincides with the geometric center of the ball 1. Also, the heating element 2 may be arranged in a sheetlike manner in the shape of a surface 3A of a sphere. This arrangement also reduces an imbalance. In other embodiments, the regulator 10 and the power source 7 are arranged on the same side of the ball 1 and a counterweight is arranged on the opposing side in order to avoid an imbalance of the ball 1. Principally, a counterweight may be used in any of the embodiments of the invention shown herein, in order to avoid an imbalance of the ball 1.

In certain embodiments, the regulator 10, the power supply 7, and/or the temperature sensor 12 are designed as a single component part. In these embodiments, this single component part may be arranged opposite to e.g. the heating element 2 in the form of a radiant heater, in order to reduce or avoid an imbalance of the ball. In certain embodiments, the heating element 2, the regulator 10, the power supply 7, and the temperature sensor 12 may be designed as a single component part. In this case, it is advantageous to arrange the single component part substantially in the geometric center of the ball 1, in order to avoid an imbalance.

The power source 7 shown in the embodiments may be batteries or rechargeable electric accumulators. In some embodiments, the ball 1 comprises an electric generator, in addition or as an alternative to the power source 7. The electric generator is positioned to convert kinetic energy and/or rotational energy of the ball 1 into current. This current is then fed either to the heating element 2 (if necessary via a regulator 10) or the accumulator 7. The regulator 10 may also distribute the current provided by the generator 7 among the heating element 2 and the accumulator 7 such that part of the generated current is fed to the heating element 2 and another part of the generated current is fed to the accumulator 7. This division may occur dynamically, for example depending on how large the deviation of the temperature measured inside the ball is from the desired (preset) temperature.

The ball 1 may only comprise a generator, as described above, and no accumulator, as the power source 7. In such a case, the generator 7 alone represents the power source 7, which provides the heating element 2 with current (if necessary via a regulator 10).

According to some embodiments, the ball 1 may be preheated before its use, for example before a football game. For this, the ball 1 could be heated from outside in a heating device, such as an oven. The ball 1 may also be connected to a charging device. For example, the ball 1 may be heated via the current applied from outside and the heating element 2, which also simultaneously charges the power supply 7, such as an accumulator. Furthermore, any combination of these heating concepts may be included with the ball 1. For example, the ball 1 may connected to a charging device inside a heating device.

In as far as a characteristic is to be provided "substantially" in the description and the claims, this means that the characteristic concerned is to be provided while taking into account production tolerances and/or measuring accuracies and/or deviations caused through the use of the ball.

In other embodiments, a cooling element may be used instead of a heating element 2, in order to cool the ball, e.g. at high ambient temperatures. Everything that has been explained in relation to a heating element 2 in this description correspondingly applies if the heating element 2 is replaced by a cooling element.

The use of a cooling element instead of a heating element 2 is appropriate when a ball is used at high ambient temperatures. The characteristics of a ball 1 for a ball sport also change at high temperatures, for example in summer or in warm countries, in an undesired manner—similar to the effects described above with regard to low temperatures. In particular, the ball becomes difficult to control. At high temperatures, the chemical characteristics in particular of the outer casing 5 of the ball 1 may change. Thus, for example, the contact characteristics between the football shoe and the ball 1 may be altered. The ball 1 could "stick" to the shoe and the deformation of the ball 1 would be greater, i.e. the ball 1 would be softer. The rebound behavior and the desired stiffness of the ball 1 may also change. A player could be irritated by such changes when kicking the ball.

For example, such a cooling element may be a so-called Peltier element, which is based on the so-called Seebeck effect. A Peltier element comprises at least two semiconductors and cools down on one side upon current flow, while it heats up on the other side. A Peltier element may be arranged within the ball 1 such that the cooling side is arranged at the outer casing 5 and cools the ball 1 down, so that the ball 1 substantially maintains its characteristics at high temperatures.

A further or additional possibility of cooling the ball 1 lies in the use of an evaporator. In an evaporator, a medium, e.g. water, changes its aggregate state from liquid to gaseous. The energy required for this is obtained from the heat of the surrounding environment. The evaporator thus cools down its surrounding environment. An evaporator arranged within the ball could thus cool the ball 1.

The ball 1 may also comprise small openings, in order to discharge the steam generated by the evaporator.

The evaporator may also be used in combination with a different cooling element. For example, the above described Peltier element may be arranged under the outer casing 5, so that the cooling side of the Peltier element rests against the outer casing 5. The heat of the warm side of the Peltier element may be dissipated by an evaporator.

A cooling element may principally be arranged within the ball 1, as described above with regard to a heating element 2. The supply of power for the cooling element may occur in the same manner as described above with regard to a heating element 2. For this, the ball 1 can comprise a power source 7 that is arranged in the above described manner.

The ball provided with a cooling element may comprise a regulator 10, which regulates the temperature of the ball 1 in the above described manner. For example, the regulator 10 may then provide the cooling element with current when the temperature of the ball rises above a certain threshold value. The ball 1 may be equipped with a temperature sensor 12, which for example measures the temperature of the outer casing 5, the bladder 4, and/or within the bladder 4. Alternatively or additionally, the ball 1 may be equipped with a pressure sensor. If, due to high outside temperature, the pressure of the air or the filler gas within the ball 1 rises above a certain threshold value, the regulator 10 then provides the cooling element with current, so that the temperature and thus the pressure of the air or the filler gas of the ball drops.

In the following, further examples are described to facilitate the understanding of the invention:

1. Ball (1) for a ball sport, characterized in that the ball (1) comprises at least one heating element (2).
2. Ball (1) according to example 1, whereby the heating element (2) is an electrically conductive fabric.
3. Ball (1) according to example 1, whereby the heating element (2) is a radiant heater.
4. Ball (1) according to example 3, whereby the radiant heater (2) is arranged substantially at the geometric center of the ball (1).
5. Ball (1) according to example 1, whereby the heating element (2) is a conductive polymer.
6. Ball (1) according to one of the preceding examples, whereby the ball (1) is inflatable.
7. Ball (1) according to one of the preceding examples, whereby the ball (1) comprises a bladder (4) in its interior and the heating element (2) is arranged on the bladder (4).
8. Ball (1) according to example 7, whereby the heating element (2) is a heating wire that is vapor-deposited or imprinted on the bladder (4) or a wire mesh that is vapor-deposited or imprinted on the bladder (4).
9. Ball (1) according to one of the preceding examples, whereby the heating element (2) is arranged within an outer casing (5) of the ball (1).
10. Ball (1) according to one of the preceding examples, whereby the ball (1) comprises a valve (8) that comprises a first end, which is arranged outside the outer casing (5) of the ball (1) and a second end, which is arranged within the outer casing (5) of the ball (1), whereby the heating element (2) is arranged at the second end of the valve (8).
11. Ball (1) according to one of the preceding examples, comprising at least one electrical power source (7), which provides an electrical current for heating the heating element (2) and with which it is electrically connected.
12. Ball (1) according to example 10, whereby the power source (7) is arranged substantially opposite to a valve (8) of the ball (1), or in the geometric center of the ball (1).
13. Ball (1) according to example 11, whereby the power source (7) is a battery or an accumulator battery.
14. Ball (1) according to one of examples 11 to 13, whereby the power source (7) can be charged by means of electromagnetic induction.
15. Ball (1) according to one of the preceding examples, whereby the ball (1) comprises at least one electric generator that is suited to convert rotational energy and/or kinetic energy of the ball (1) into current, which can be fed to the heating element (2) and/or the power source (7).

16. Ball (1) according to one of the preceding examples, further comprising a regulator (10), which is suitable for regulating the current for heating the heating element (2) in such a manner that a temperature of the ball (1) substantially reaches a predetermined value.

17. Ball (1) according to example 16, whereby the predetermined value lies between 5° C. and 15° C., preferably between 8° C. and 12° C., further preferably at 10° C.

18. Ball (1) according to one of examples 16 to 17, whereby the regulator (10) is a switch that is suitable to automatically turn on the current for heating the heating element (2) when a temperature of the ball (1) falls below a first predefined threshold value, and automatically turn said current off when a temperature of the ball (1) rises above a second predetermined threshold value.

19. Ball (1) according to one of the examples 16 to 18, whereby the temperature is a temperature of the filler gas of the ball (1) or a temperature of the outer casing (5) of the ball (1).

20. Ball (1) according to one of the preceding examples, whereby the heating element (2) and/or the power source (7) and/or the regulator (10) are arranged in such a manner that the center of mass of the ball (1) substantially coincides with the geometric center of the ball (1).

21. Ball (1) according to one of the preceding examples, whereby the heating element (2) and/or the power supply (7) and/or the regulator (10) are arranged in such a manner that the distribution of mass of the ball (1) is substantially spherically symmetric.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A ball for a ball sport comprising:

at least one heating element arranged inside the ball and substantially at a geometric center of the ball; and a regulator arranged inside the ball suitable for regulating a current for heating the at least one heating element in such a manner that a temperature of the ball substantially reaches a predetermined value, wherein the regulator constantly regulates the current provided to the at least one heating element when the ball is used from zero to a maximum available current.

2. The ball according to claim 1, wherein the at least one heating element is an electrically conductive fabric.

3. The ball according to claim 1, wherein the at least one heating element is a radiant heater.

4. The ball according to claim 1, wherein the at least one heating element is a conductive polymer.

5. The ball according to claim 1, wherein the ball is inflatable.

6. The ball according to claim 1, wherein the ball comprises a bladder in its interior and the at least one heating element is arranged on the bladder.

7. The ball according to claim 6, wherein the at least one heating element is a heating wire that is vapor-deposited or imprinted on the bladder or a wire mesh that is vapor-deposited or imprinted on the bladder.

8. The ball according to claim 1, wherein the at least one heating element is arranged within an outer casing of the ball.

9. The ball according to claim 1, wherein the ball comprises a valve that comprises a first end, which is arranged outside the outer casing of the ball and a second end, which is arranged within the outer casing of the ball, whereby the at least one heating element is arranged at the second end of the valve.

10. A ball for a ball sport comprising:

at least one heating element arranged inside the ball and substantially at a geometric center of the ball;

at least one electrical power source; and a regulator arranged inside the ball suitable for regulating a current for heating the at least one heating element in such a manner that a temperature of the ball substantially reaches a predetermined value, wherein:

the at least one electrical power source provides an electrical current for heating the at least one heating element and with which it is electrically connected; and the temperature of the ball is a temperature of a filler gas of the ball or a temperature of the outer casing of the ball.

11. The ball according to claim 10, wherein the at least one electrical power source is arranged substantially opposite a valve of the ball.

12. The ball according to claim 10, wherein the at least one electrical power source is a battery or an accumulator battery.

13. The ball according to claim 10, wherein the at least one electrical power source can be charged by means of electromagnetic induction.

14. The ball according to claim 10, further comprising at least one electric generator that is configured to convert rotational energy and/or kinetic energy of the ball into current, which can be fed to the at least one heating element or the at least one electrical power source.

15. The ball according to claim 10, wherein the predetermined value ranges between 5° C. and 15° C.

16. The ball according to claim 10, wherein the regulator is a switch that is configured to automatically switch on the current for heating the at least one heating element when the temperature of the ball drops below a first predefined threshold value, and to automatically switch the current off when the temperature of the ball rises above a second predetermined threshold value.

17. The ball according to claim 10, wherein the at least one heating element, the at least one electrical power source, and the regulator are arranged in such a manner that a center of mass of the ball substantially coincides with the geometric center of the ball.

18. The ball according to claim 10, wherein the at least one heating element and/or the at least one electrical power source and/or the regulator are arranged in such a manner that a distribution of mass of the ball is substantially spherically symmetric.

19. The ball according to claim 1, wherein the regulator functions during usage of the ball regardless of an orientation or motion of the ball.

20. The ball according to claim 10, wherein, when the ball is used, the regulator constantly regulates the current provided to the at least one heating element from zero to a maximum available current.

21. A ball for a ball sport comprising:

at least one heating element arranged inside the ball and substantially at a geometric center of the ball;

at least one electrical power source; and a regulator arranged inside the ball suitable for regulating a current for heating the at least one heating element in such a manner that a temperature of the ball substantially reaches a predetermined value, wherein:

the at least one electrical power source provides an electrical current for heating the at least one heating element and with which it is electrically connected; and the at least one electrical power source is arranged substantially opposite a valve of the ball.

22. A ball for a ball sport comprising:

at least one heating element arranged inside the ball and substantially at a geometric center of the ball;

at least one electrical power source;

a regulator arranged inside the ball suitable for regulating a current for heating the at least one heating element in such a manner that a temperature of the ball substantially reaches a predetermined value; and at least one electric generator that is configured to convert rotational energy and/or kinetic energy of the ball into current, which can be fed to the at least one heating element or the at least one electrical power source, wherein:

the at least one electrical power source provides an electrical current for heating the at least one heating element and with which it is electrically connected.

23. A ball for a ball sport comprising:

at least one heating element arranged inside the ball and substantially at a geometric center of the ball;

at least one electrical power source; and a regulator arranged inside the ball suitable for regulating a current for heating the at least one heating element in such a manner that a temperature of the ball substantially reaches a predetermined value, wherein:

the at least one electrical power source provides an electrical current for heating the at least one heating element and with which it is electrically connected; and the predetermined value ranges between 5° C. and 15° C.

24. A ball for a ball sport comprising:

at least one heating element arranged inside the ball and substantially at a geometric center of the ball;

at least one electrical power source; and a regulator arranged inside the ball suitable for regulating a current for heating the at least one heating element in such a manner that a temperature of the ball substantially reaches a predetermined value, wherein:

the at least one electrical power source provides an electrical current for heating the at least one heating element and with which it is electrically connected; and the regulator is a switch that is configured to automatically switch on the current for heating the at least one heating element when the temperature of the ball drops below a first predefined threshold value, and to automatically switch the current off when the temperature of the ball rises above a second predetermined threshold value.

25. A ball for a ball sport comprising:

at least one heating element arranged inside the ball and substantially at a geometric center of the ball;

at least one electrical power source; and a regulator arranged inside the ball suitable for regulating a current for heating the at least one heating element in such a manner that a temperature of the ball substantially reaches a predetermined value, wherein:

the at least one electrical power source provides an electrical current for heating the at least one heating element and with which it is electrically connected; and when the ball is used, the regulator constantly regulates the current provided to the at least one heating element from zero to a maximum available current.

* * * * *